US006386131B1

(12) United States Patent
Barsoum

(10) Patent No.: US 6,386,131 B1
(45) Date of Patent: May 14, 2002

(54) HYBRID SHIP HULL

(76) Inventor: Roshdy George S. Barsoum, 7200 Heather Hill La., McLean, VA (US) 22110

( * ) Notice: Subject to any disclaimer, the term of this patent is extended or adjusted under 35 U.S.C. 154(b) by 0 days.

(21) Appl. No.: 09/649,140

(22) Filed: Aug. 28, 2000

(51) Int. Cl.[7] ..... B63B 3/00
(52) U.S. Cl. ..... 114/65 R; 114/357
(58) Field of Search ..... 114/355, 357, 114/65 R

(56) References Cited

U.S. PATENT DOCUMENTS 4,365,580 A 12/1982 Blount
4,719,871 A * 1/1988 Fantacci et al. ..... 114/357
4,902,215 A 2/1990 Seemann, III
5,218,919 A 6/1993 Krulikowski, III et al.
5,456,198 A * 10/1995 Smedal et al. ..... 114/65 R
5,477,796 A 12/1995 Stuart
5,582,124 A 12/1996 Sikora et al.
5,711,244 A * 1/1998 Knapp ..... 114/312
5,778,813 A 7/1998 Kennedy
5,958,325 A 9/1999 Seemann, III et al.
6,050,208 A 4/2000 Kennedy

OTHER PUBLICATIONS

"Advanced (Unidirectional) Double–Hull Technical Symposium", Oct. 25–26, 1994, National Institute of Standards & Technology, Gaithersburg, Maryland.

SSC–360, "Use Of Fiber Reinforced Plastics In The Marine Industry", Ship Structure Committee, 1990.

* cited by examiner

*Primary Examiner*—Stephen Avila
(74) *Attorney, Agent, or Firm*—Paul M. Craig, Jr.

(57) ABSTRACT

A hybrid ship hull which includes three parts and whose stem and bow parts are made of composite materials while the mid-section is made of hybrid steel framing with a composite skin or of advanced double-steel hull or of conventional steel hull construction.

31 Claims, 6 Drawing Sheets

HYBRID SHIP HULL

The U. S. Government has a non-exclusive, royalty-free license to practice the subject invention for government use.

FIELD OF THE INVENTION

This invention relates to a hybrid ship hull in which different sections are made of different materials, and more particularly to a hybrid ship hull whose stern and bow section are made of composite materials while its mid-section is made of a hybrid steel framing with a composite skin, of advanced double-steel hull or of conventional steel hull, especially for use with ships of lengths of at least about 300 feet or greater.

BACKGROUND OF THE INVENTION

Current ship hulls are normally made of steel which is magnetic and thus entails the well-known disadvantages thereof, especially during war-time conditions. Traditional shipyard designs use conventional single-hull constructions with longitudinal stringers and transverse framing. To achieve non-magnetic capabilities, stainless steel hulls are recently being investigated for the next generation of Navy ships.

Current Navy ships have simple bow and stern geometries. Advanced hulls, such as the tumblehome hull envisioned by the Navy, may use water jet propulsion systems, a modified water jet, shrouded propellers or other complex geometry. The complex stern section, associated with these propulsor systems, could be long sections and require double curvature and appendages, which are expensive to form using steel plating or forging. In addition, steel construction would make the bow and stern sections extremely heavy.

The revolutionary "wave piercing" bow of advanced hull forms, such as the tumblehome hull, is envisioned to have also complex curvature for stealth, seakeeping or maneuvering, not seen in any previous ship construction. Forming steel for a long bow section with double curvature would be very expensive and extremely heavy. The heavy mass concentration of a steel stern and bow would create problems in maneuvering and seakeeping. Current steel construction of ships would give a very heavy bow and stern section, which leads to large whipping moments in underwater explosion.

The manufacturing process of steel hulls involves welding which, in turn, produces residual stresses leading to large plate (dishing) deformations, which are also called at times "hungry horse." These deformations reduce the fatigue life and stealth characteristics of the hull. To assure manufacturing tolerances, it is necessary to relieve the residual stresses by heat treatment, which is a very high cost operation, or to use some advanced welding technology that would minimize residual stresses, such as, for example, laser welding, which, however, is generally not yet available at shipyards. To date, the alternative is to build the hull out of composite materials, known as such in the art. However, several studies have indicated that for hulls longer than about 200 feet, even carbon fiber composites do not provide the necessary stiffness and strength required for the hull. Furthermore, the cost of carbon fiber composites which is currently \$12–18 per pound of carbon fiber as compared to \$0.45~\$0.5 per pound for high strength steel, would be prohibitive for ships of this size. Low cost, high performance composite materials such as glass fiber composites (GRP) using resin transfer molding processes which are presently used in patrol boats, Corvettes and mine hunters, do not offer the stiffness nor the in-plane strength required for long hulls of combatant ships or other large commercial ships. The load-carrying mechanism for long ships is by axial tension and compression in the hogging and sagging mode between waves. The technology of composite sandwich construction, which is common in smaller ship lengths or boats, does not satisfy the carrying capability for sea loads in longer ship hulls. The in-plane strength of the composite material is therefore critical. Moreover, for small ships and boats, the bending strength of the composite material is critical. The present technology of composite sandwich construction which is common in smaller ship lengths or in boats would not add to the carrying capability for sea loads in long ship hulls.

Advanced double-hull constructions of the type disclosed in U.S. Pat. Nos. 5,218,919 and 5,477,797 are presently under development. Additionally, for naval applications, a modification of these concepts, as disclosed in U.S. Pat. No. 5,582,124 is presently considered. Composite hulls for naval vessels is also presently being considered. Composite hulls for naval vessels of lengths less than 300 feet are presently built with the use of GRP or carbon fiber sandwich construction using a patented process called "SCRIMP" (U.S. Pat. Nos. 4,902,215 and 5,958,325). In these types of constructions, the entire hull is made of the same material which is different from and must be distinguished from a hybrid construction according to this invention where more than one material is used.

The U. S. Pat. No. 4,365,580 to Blount discloses a steel hull construction forming an inner box-like structure with a fiberglass outer hull. In this patent the steel box thereby carries all the sea loads such as bending moments and shear stresses while the composite shell and foam transmits the water pressure to the box. The construction according to this patent therefore resembles a steel hull covered with an add-on parasitic composite skin that gives it the shape. The other patents mentioned in the Blount '580 Patent are sandwich-type constructions in which a synthetic foam material is sandwiched between inner and outer shells and hence are not hybrids of two different materials. Additionally, in the construction according to the Blount '580 Patent, the composite material is an added weight to the steel load-carrying hull which is detrimental to speed and efficiency. Furthermore, in the '580 Patent, the bow and stern have no load-carrying capability and would not work for a naval combatant ship or larger commercial vessel as contemplated by the present invention.

U.S. Pat. No. 5,778,813 to Kennedy discloses a composite laminated panel for containment vessels such as double-hull oil tankers. It is composite in the sense that it involves a steel double hull with an elastomer core in between. However, this patent also does not disclose or suggest the present invention because the steel thereof carries all sea loads, and the elastomer merely acts in shielding the inner hull from cracks when the outer hull is pierced, ruptured or penetrated.

BRIEF DESCRIPTION OF THE INVENTION

The present invention is based on the concept to subdivide the hull of a ship into three parts, i.e., the bow section, the middle section and the stern section which utilize different materials for their construction. The bow and stern sections are thereby made of a composite material such as glassed reinforced plastic (GRP) material while the mid-section utilizes a steel framing. In one embodiment, the mid-section is made of a hybrid stainless steel framing with a wetted outside skin or, alternatively, of an outer skin and of an inner shell for a double hull whereby the composite sections may have a length of about 20 feet to about 30 feet. In another embodiment of this invention, the mid-section of the hull would be made of Stainless Steel Advanced Double Hull construction (SSADH) as disclosed, for example, in U.S. Pat. No. 5,582,124. The hybrid stainless steel arrangement has a novel arrangement of longitudinal beams joined by vertical and horizontal beams is provided whereby at least some of the beams are made of stainless steel and preferably are box-type beams. The two truss-like structures on the port and starboard sides are connected by top and bottom horizontal beams, thereby forming a box-like structure to assure the required lateral and torsional stiffness and to resist beam and oblique sea loads. Furthermore, to connect the outer skin panels to the steel frame of the mid-section of the first embodiment, shear connectors are preferably provided along the entire length of the longitudinal box beams as well as the vertical and horizontal framing which utilize a novel construction of two concentric cylinders. To provide dynamic load attenuation, an elastic material may be sandwiched between the composite and the framing. To connect the bow and stern sections with the mid-section, a novel arrangement of pre-stressing cables are used between the bow and the mid-section as also between the stern and the mid-section whereby these pre-stressing cables have a moment-carrying capacity equal to the total moment-carrying capacity of the composite bow and stern cross section. Additionally, water-tight end bulkheads are preferably provided at the transitions from the mid-section to the bow and the stern sections. To eliminate peeling or de-lamination, a lap-type connection between the composites of the end sections and the steel framing may be used by staggering the skin as well as a terminal plate-like part of the steel mid-section, and/or stiffness thereof. Punched holes are provided in the steel plate and/or stiffeners for stitching out-of-plane glass or carbon fibers, whereby the stitching operation precedes the co-curing process of the composites. In the alternative, a scarf joint may be used in the connection between the steel plate and/or stiffeners and the composite panels of the end sections.

Two types of construction are therefore proposed for the main or mid-section according to this invention. One type of construction utilizes a stainless steel framing with a wetted outside skirt or, alternatively, an outer skin and inner shell for double-hull construction, whereby the outer sections are preferably made of composite sections with a length of about twenty to about thirty feet. The alternative construction for the mid-section of the hull according to this invention utilizes only stainless steel and is preferably of Stainless Steel Advanced Double-Hull construction (SSADH) as disclosed, for example, in U.S. Pat. No. 5,582,124.

The three-section ship hull construction of this invention provides a stealthy, affordable ship hull whose hybrid hull with its composite bow and stern section would allow the manufacture of any shape necessary to meet signature requirements at much lower cost. Furthermore, the light-weight stern and bow sections would lead to superior maneuvering and sea-keeping, maneuvering, fuel efficiency and speed, in addition to reducing the whipping moments in case of underwater explosions.

BRIEF DESCRIPTION OF THE DRAWINGSB

These and other objects, features and advantages of the present invention will become more apparent from the following description when taken in connection with the accompanying drawing which shows, for purposes of illustration only, several embodiments in accordance with the present invention, and wherein.

Figure 8:
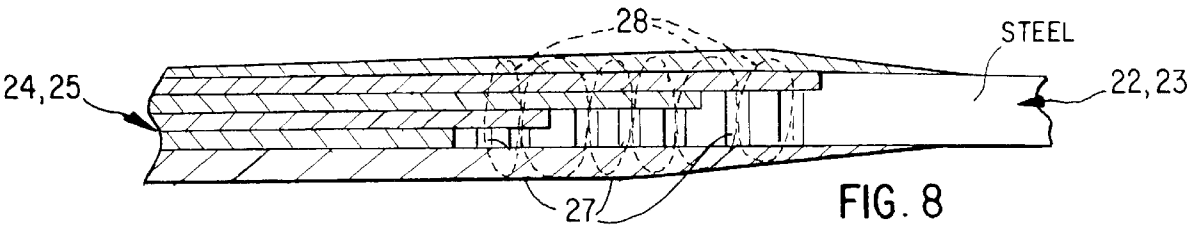
Figure 9:
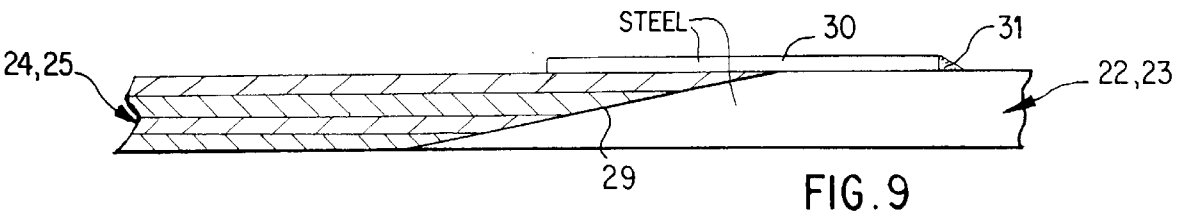

FIG. 8 is a partial cross-sectional view through the connection of a stainless steel plate with the laminated composite plates of the main section and bow or stern section, respectively, utilizing stitching to prevent peeling or de-lamination; and FIG. 9 is a partial cross-sectional view, similar to FIG. 8, through the connection of a stainless steel plate with the laminated composite plates of the main section and bow or stern section, respectively, utilizing stitching to prevent peeling or de-lamination.

DETAILED DESCRIPTION OF THE INVENTION

Figures 1A, 1B:
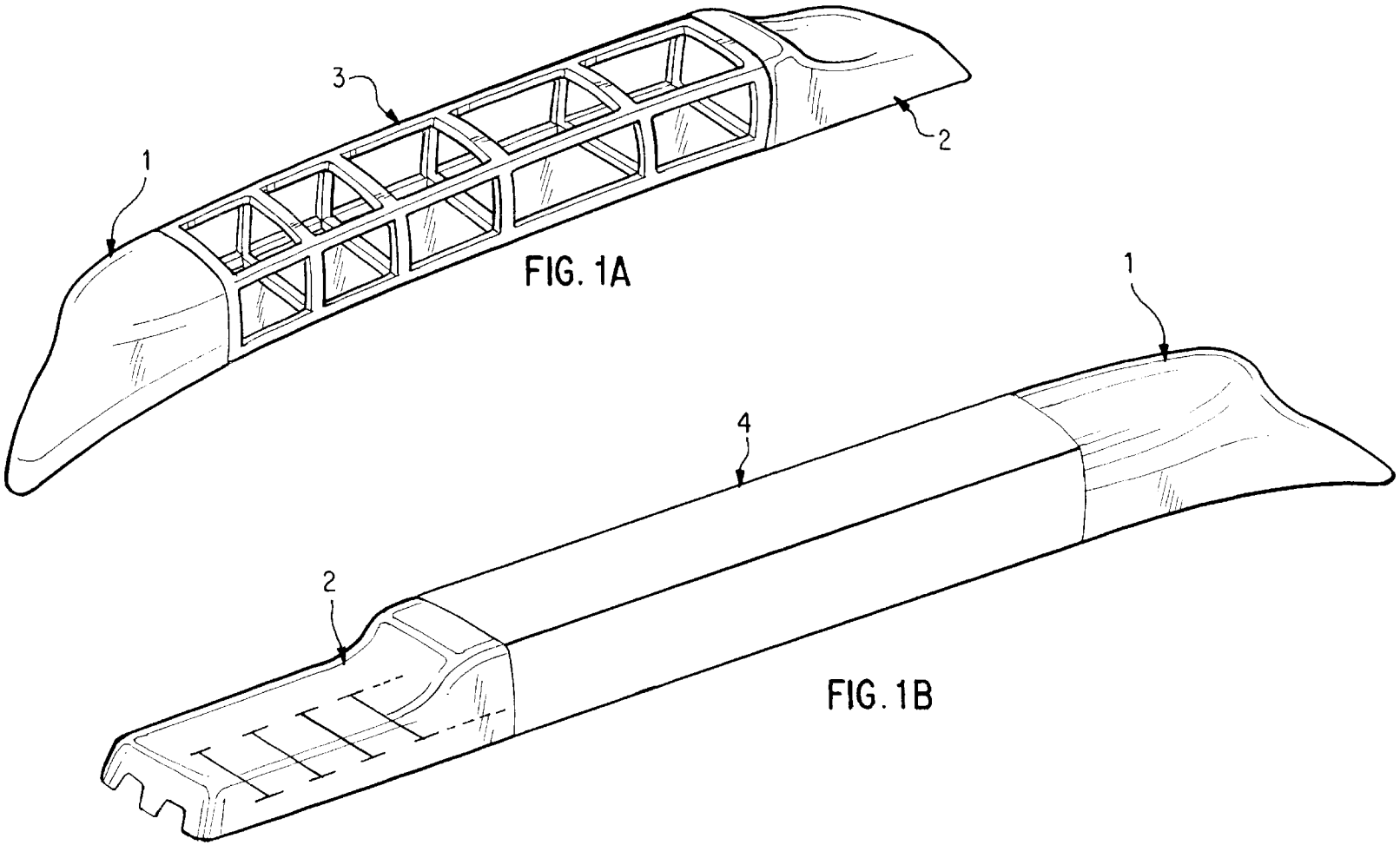
FIG. 1A is a somewhat schematic perspective view of a first embodiment of a hybrid hull construction in accordance with the present invention utilizing a first type of construction for the mid-section of the hull.
FIG. 1B is a somewhat schematic perspective view of a second embodiment of a hybrid hull construction in accordance with this invention, utilizing a modified stainless steel double hull mid-section construction.

Referring now to the drawing wherein like reference numerals are used throughout the various views to designate like parts, and more particularly to FIG. 1A, reference numeral 1 generally designates the bow section, reference numeral 2 the stern section and reference numeral 3 the mid-section of a hybrid hull of a first embodiment in accordance with the present invention in which the mid-section 3 includes a stainless steel frame and a wetted outside skin made of composite sections with a length of about 20 to 30 feet. In the alternative, the mid-section 3 may include an outer skin and inner shell for a double-hull of conventional construction in which the outer skin is again made of composite sections with a length of about 20 to about 30 feet. The composite bow section 1 and composite stern section 2 of the hull in accordance with this invention are preferably made of Glass Reinforced Plastic (GRP) and in particular are made of GRP using E-glass. The bow and stern sections 1 and 2 may be of single-skin, unstiffened monocoque construction or may be of PVC-core sandwich construction or may be of transversely stiffened single skin construction depending on the length and beam of these sections.

FIG. 1B schematically illustrates a hull construction in accordance with the present invention in which the bow and stern sections 1 and 2 are again made of composite material as described in connection with FIG. 1A while the mid-section generally designated by reference numeral 4 of this embodiment consists of a stainless steel double-hull. As the stainless steel of the mid-section 4, preferably of the Stainless Steel Advanced Double-Hull (SSADH) construction, for example, as disclosed in U.S. Pat. No. 5,582,124, will be in contact with the sea water, it has to be a non-magnetic, super-austinetic stainless steel such as, for example, AL6-XN, to prevent crevice corrosion.

Figure 1C:
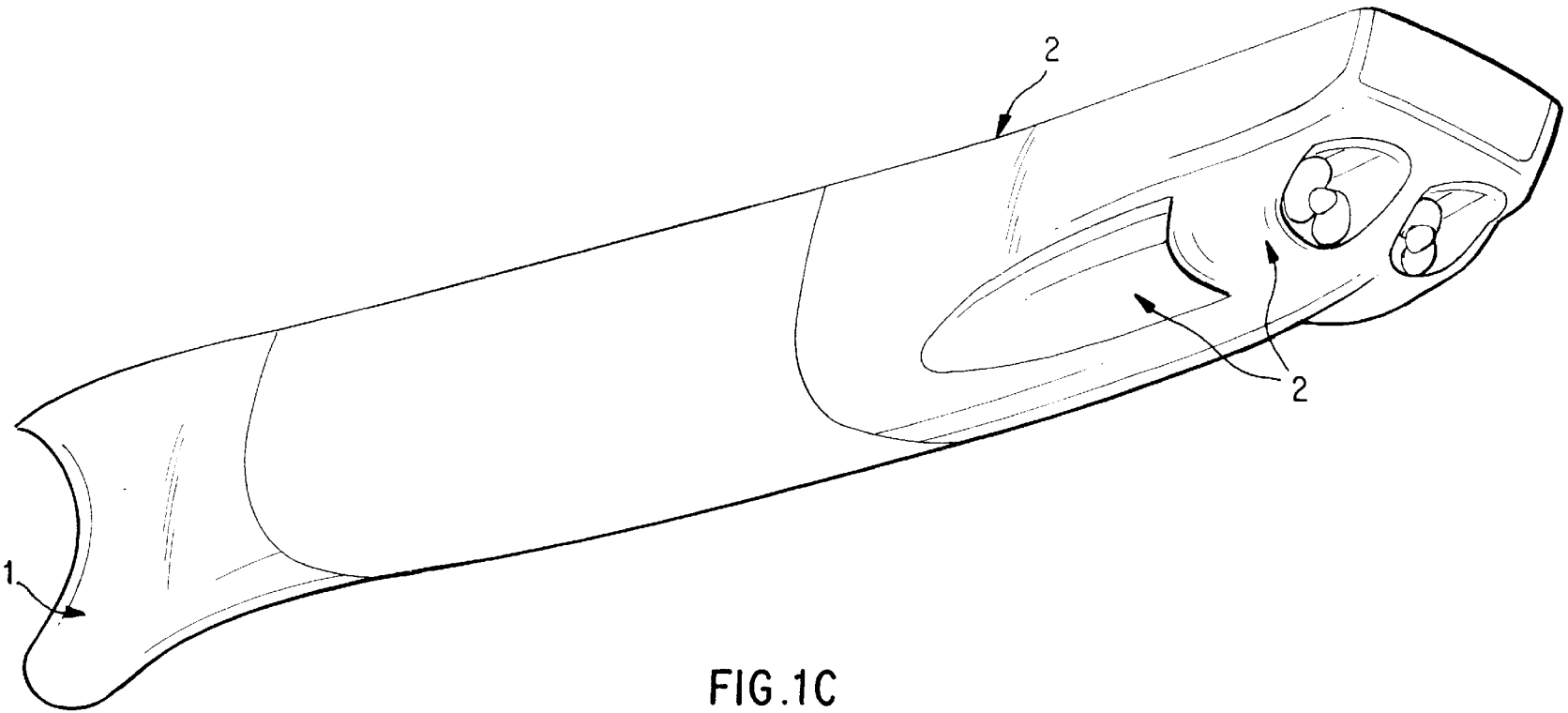
FIG. 1C is a somewhat schematic perspective view of a typical hull construction with a complex curvature geometry made possible by the composite bow and stern sections in accordance with this invention, and viewing the hybrid hull from the side and bottom.

The load-carrying part of the mid-section of the hull according to this invention may have two alternative types of construction, as disclosed in FIGS. 1A and 1B. The use of composite bow and stern sections of the hybrid hull in accordance with this invention will allow the use of complex geometry and double-curvature surfaces to attain hydrodynamic advantages and reduce maneuvering and safe-keeping requirements. FIG. 1C illustrates schematically typical double curvature surfaces of the bow and stern sections which can be realized with a hull of this invention. The use of a composite skin and stainless steel inner framing in the embodiment of FIG. 1A for the mid-section thereby offers lighter weight and lower cost than a Stainless Steel Advanced Double Hull.

Figure 2:
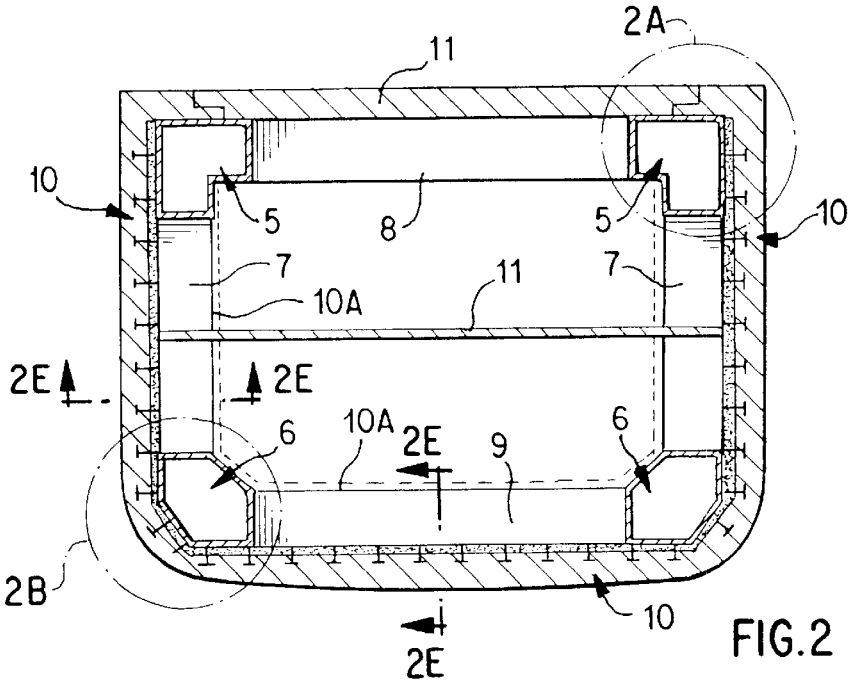
FIG. 2 is a transverse cross-sectional view of the mid-section utilizing a first type of construction for the mid-section of the hybrid hull.
Figure 2A:
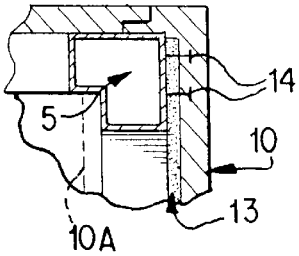
FIG. 2A is a partial cross-sectional view through the right upper part of the mid-section of a hull construction in accordance with the present invention and schematically showing shear connectors as used with this invention.
Figure 2B:
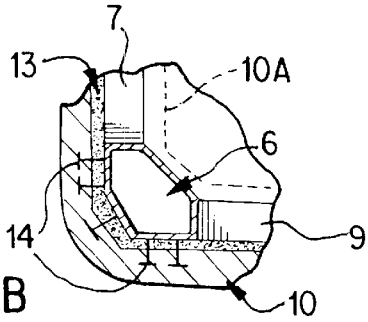
FIG. 2B is a cross-sectional view through the lower left part of the mid-section of FIG. 2 and schematically illustrating shear connectors as used with this invention.
Figure 2D:
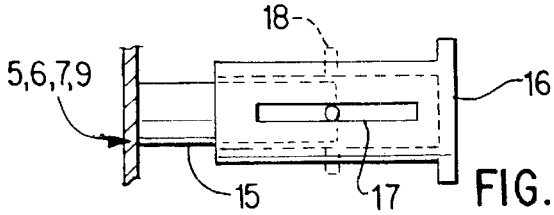
FIG. 2D is a somewhat schematic plan view, on an enlarged scale, on the shear connector of FIG. 2C.
Figure 2C:
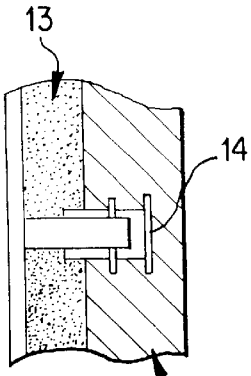
FIG. 2C is a somewhat schematic partial cross-sectional view, on an enlarged scale, through an area of the mid-section of FIG. 2, and schematically illustrating a shear connector in accordance with this invention.
Figure 2E:
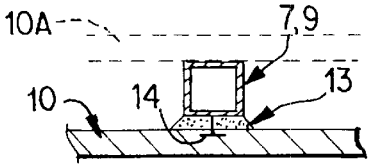
FIG. 2E is a partial schematic of a cross section of E—E of FIG. 2.

FIG. 2 is a transverse cross-sectional view of the mid-section 3 of a hull illustrated in FIG. 1A which includes an upper box beam 5 in each of the upper corners, a lower box beam 6 in each of the lower corners, a vertical beam 7 interconnecting the box beams 5 and 6, a top beam 8 interconnecting the two upper box beams 5 and a bottom beam 9 interconnecting the two lower box beams 6. The vertical beams 7 as also the top and bottom beams 8 and 9 are preferably located in areas of bulkheads which are located in the areas of the connections of the bow and stern sections with the main section. The outer composite skin 10 is connected to the box beams 5 and 6 and to the beams 7 and 9 by shear connectors 14, which may be of any conventional construction. However, according to this invention, the shear connectors 14 are preferably made of two stainless steel cylinders 15 and 16 (FIG. 2D) whereby the cylinder 16 is provided with slots 17 and the cylinder 15 has keys 18 to prevent the cylinders from disengagement. Preferably an elastomeric material layer 13 (FIG. 2C) is placed between the steel framing and the composite skin 10.

In the embodiment of a hybrid hull construction with an inner shell for a double-hull construction 10A, a direct connection with the use of bolts or other appropriate fasteners may be used.

Figure 3:
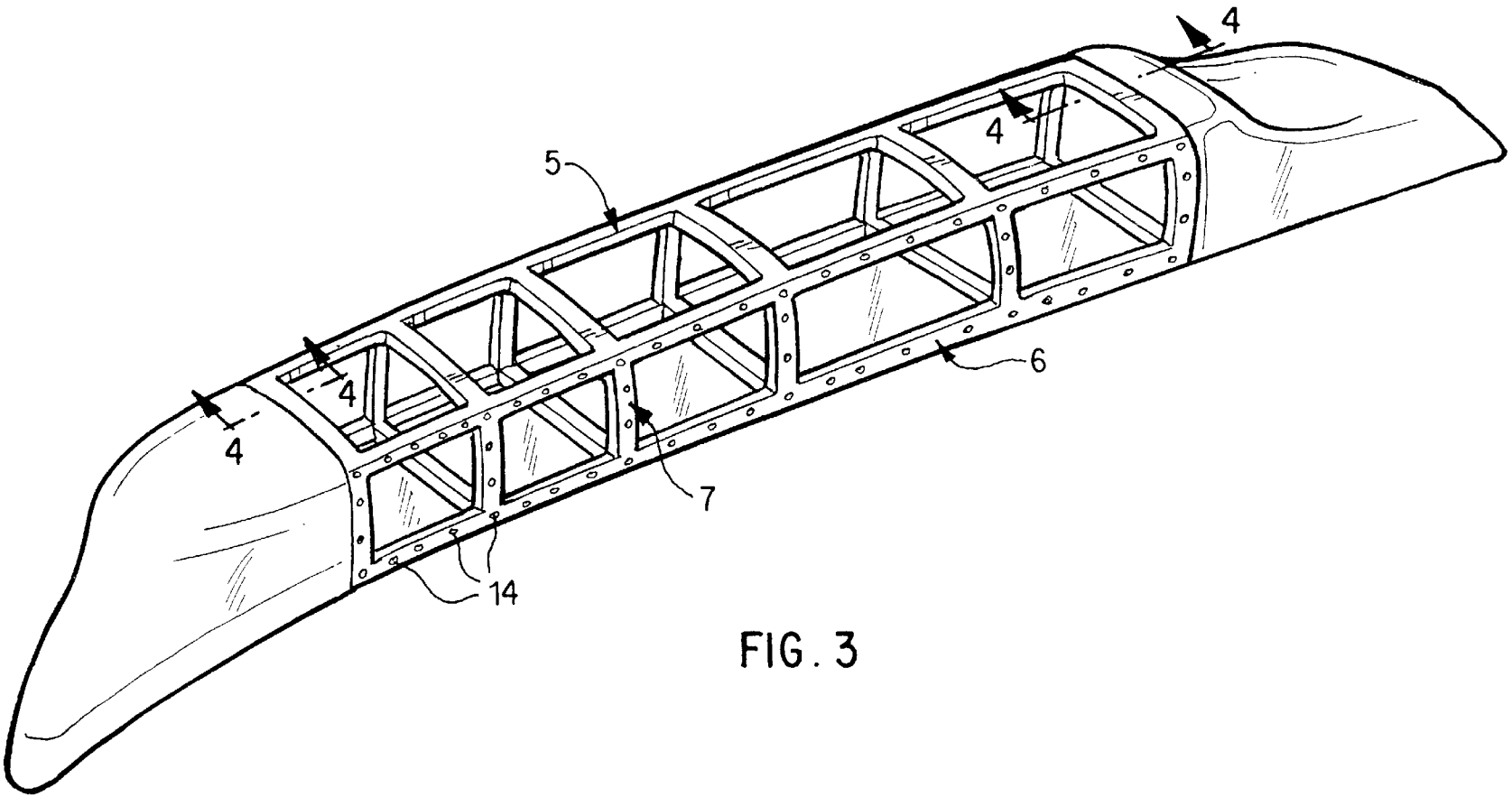
FIG. 3 is a somewhat schematic perspective view of a hull construction in accordance with the present invention which utilizes shear connectors on the framing and outer composite skin.

FIG. 3 illustrates a perspective view of a hybrid hull construction in accordance with this invention, illustrating schematically the location of the shear connectors 14 which transfer the shear loading to the composite outer skin 10 from the framing 5, 6, 7 and 9.

The upper deck 11 in FIG. 2 may be of a construction similar to that of the outer skin while the mid-deck 12 may be of any appropriate construction utilizing, for example, stainless steel or composite.

Figure 5:
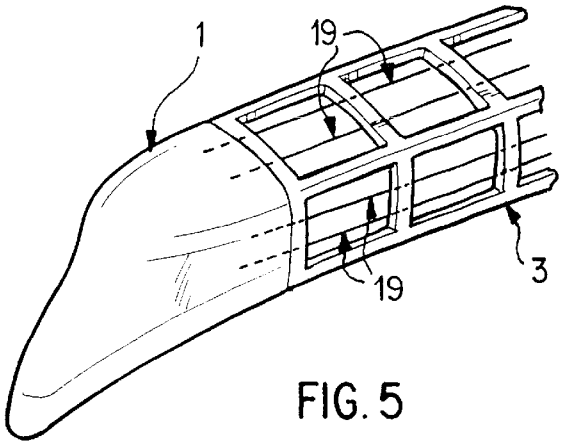
FIG. 5 is a somewhat schematic partial perspective view illustrating the use of pre-stressing cables connecting the composite bow to the mid-section of the alternative construction of the mid-section.
Figure 6:
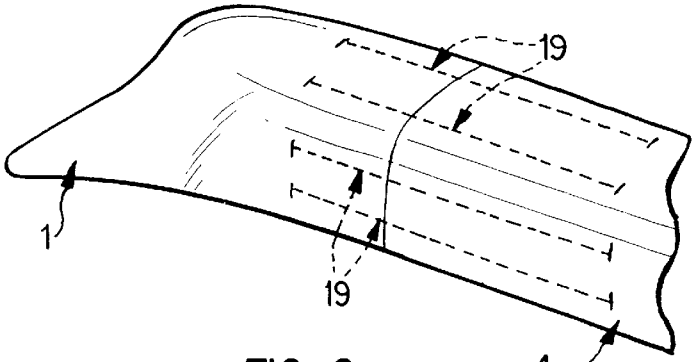
FIG. 6 is a somewhat schematic view, on an enlarged scale, illustrating the use of pre-stressing connecting cables between the bow or stern sections and the mid-section with the use of water-tight end bulkheads in these connections.
Figure 4:
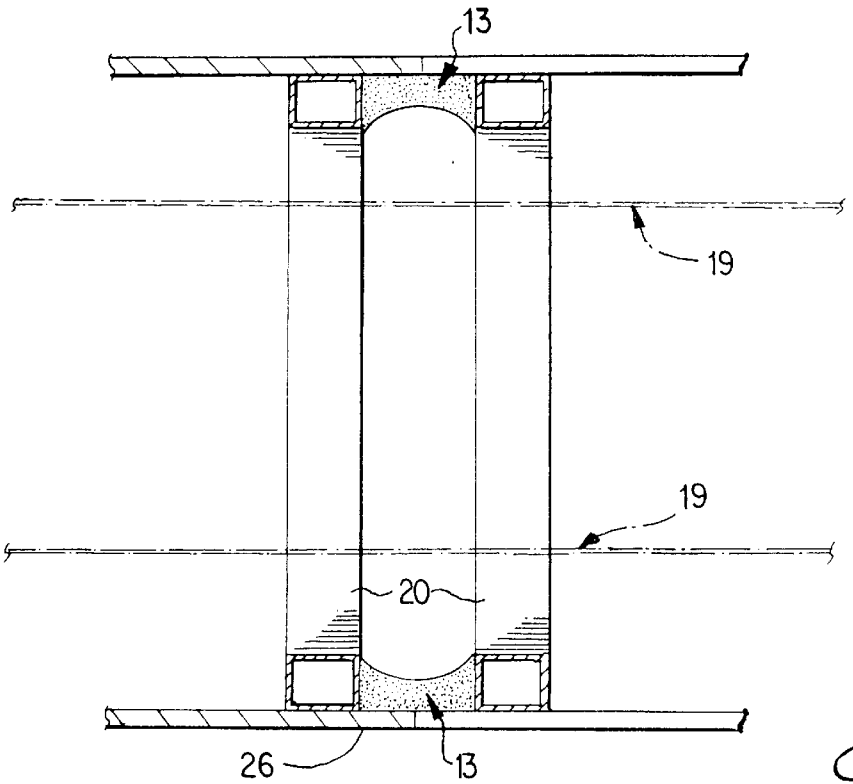
FIG. 4 is a partial somewhat schematic perspective view illustrating the use of pre-stressing cables connecting the composite bow section to the first embodiment of a mid-section.

FIGS. 4 and 5 illustrate schematically the connection of the bow sections of the embodiments of FIGS. 1A and 1B with the use of pre-stressing cables 19 for connecting the end sections 1 and 2 with the mid-section 3 or 4. FIG. 6 illustrates details of the connections between the composite bow 1—or stern 2—and the mid-section 3 or 4 which includes double water-tight end bulkheads 20. The pre-stressing cables 19 are thereby embedded in the composite bow section 1 or stern section 2 and extend to the mid-sections 3 and 4 through protection sleeves anchored in the steel frames 7, 8 and 9. The double water-tight bulkheads have elastomeric material 13 of any appropriate known type between the individual bulkheads for protection at extreme loading.

Figure 7:
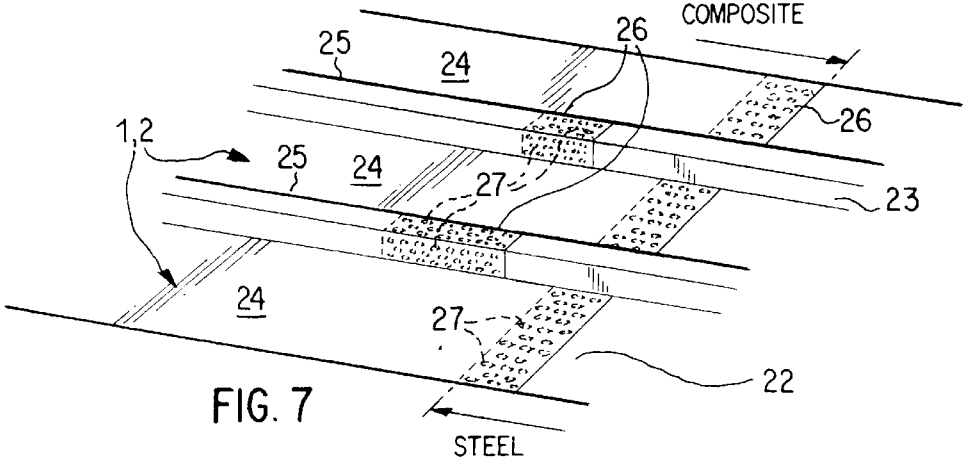
FIG. 7 is a partial somewhat schematic perspective view illustrating details of the connection of a composite end section with the steel mid-section of the hull by the use of box beams in accordance with the present invention.

FIG. 7 illustrates connections 26 in the type of hull construction of FIG. 1B between the mid-section steel double hull 4 and the composite bow section 1 or stern section 2. The composites of the end sections 1 or 2 are thereby co-cured with the steel details. The mid-section 4 of the steel double hull construction as shown in FIG. 1B terminates as a plate 22 and/or hat stiffeners 23 which are joined to the composite bow section 1 or stern section 2. Composite stiffeners 25 are aligned with the steel stiffeners 23. The connection 26 is thereby staggered between the plates 22, 24 and stiffeners 25, 23. Two concepts are possible according to this invention for the connections 26. A first concept utilizes a stepped lap joint and a second concept utilizes a scarf joint. The lap joint is made by machining the steel into steps and introducing punched holes 27 in the steel plate 22 and/or in the stiffeners 23. Glass or carbon fibers 28 extending through the punched holes 27 are then stitched out of plane. The stitching process which is of known type is made before the co-curing process. The scarf joint is made at such an angle 29 between the steel and the composite as to minimize the interlaminar and shear stresses at the joint. A steel plate 30 is thereby welded at 31 to the steel mid-section 4 to eliminate any out-of-plane peeling stresses at the end of the scarf joint.

The novel hybrid hull construction of FIGS. 1A and 1B in accordance with this invention would be able to carry the load. Moreover, to achieve stealth advantages as well as low maintenance at affordable costs, GRP composites are the preferred choice in this invention.

A major advantage of composite hulls is the ability to have high dimensional control and allows designers to incorporate many stealth features. The "hungry horse" effect, found on all Naval welded steel ships, reduces its stealth characteristics. Furthermore, it is extremely expensive to reduce these welding distortions, but with composites, high dimensional control can be easily and economically achieved. In addition, composites are non-magnetic, allow designers to embed radar-absorbing or reflection materials, tailor their electromagnetic and dielectric characteristics, and embed sensors. Composites have high damping and can be tailored to reduce the acoustic signature. Composites also require low maintenance and have no corrosion or galvanic problems.

The main difference of the hull construction in accordance with this invention compared to the prior art resides in the fact that the instant invention consists of three parts; namely, of a stem and of a bow part made of a composite material and of a steel mid-section of either FIG. 1A or 1B which carries the load. In the embodiment of FIG. 1A, the mid-section is made of a steel frame which, together with the deck and the hull bottom, carry only the bending loads as axial loads in the top and bottom frame members while the composite outer skin carries the in-plane shear and water pressure loads. In the embodiment of the double-hull hybrid construction which may also be used in the embodiment of FIG. 1A, the inner shell will carry the shear load symmetrically with the outer skin. The instant invention thus provides a highly efficient use of material in carrying the sea loads. Each material thereby carries the loads which it can carry best, i.e., the steel carrying axial loads and providing high stiffness while the composites carry distributed shear and pressure loads. Thus, this invention provides a more efficient, cost-effective and lighter hull construction.

In the embodiment of FIG. 1A preferably utilizing a stainless steel frame, the composite lay-up is preferably continuous with the composite bow and stern sections to transmit the load to the frame and then reduced to a +45°/−45° quasi-isotropic lay-up for the rest of the mid-section of the hull. The composite sections are spliced to each other and to the bow and stern sections to make a water-tight hull. The outer skin of the main section 3 of the embodiment of FIG. 1A is connected to the main stainless steel frame at the main joints in order to carry only the shear loads and the hydrostatic water pressure normal to the hull surface. The connection between the outer skin and the main steel frame can carry only shear loading while the water pressure loading is carried by an elastomeric material between the skin and the framing (see also FIGS. 2A–2E). If, in the alternative, a GRP outer skin and an inner shell are used in a double-hull type construction, the shear loads are carried in a symmetric fashion. In that case, the inner shell is directly bolted to the framing. Since the stainless steel used in this type of construction does not come in contact with sea water, lower grades of non-magnetic stainless steel can be used such as, for example, ASTM 316 SS or other 300 series stainless steels. The top and lower cords of the stainless steel framing are preferably heavy box girders for weapons effect protection. The deck is preferably of sandwich composite construction while the bottom is of the same type of composite material as the side panels with significant reinforcements. In the embodiment of FIG. 1B, the mid-section of the hull is made only of stainless steel advanced double-hull (SSADH).

The composites used in the construction of the bow section, stern section and the mid-section of the type illustrated in FIG. 1A is preferably of marine quality glass reinforced plastic using E-glass. For stealth purposes, the outer skin may possibly have a thin layer of carbon fiber or alternatively thin layers of other materials.

In all embodiments of this invention, the stern section may require internal steel frames to provide the required stiffness for the engine, transmission end shaft(s). Special dynamic performance and water-tightness is desired for joining the composite bow and stern sections to the mid-section stainless steel SS frame or the SSADH. These joints are preferably of the type to provide shock absorptions and impedance matching on both sides of the joint. In addition to water-tight end bulkheads, the mid-sections of the embodiments of FIGS. 1A and 1B are preferably provided with water-tight doors and hatches. According to this invention, one of the novel methods is to directly bond the composite ends to the steel shell. To achieve an excellent load-carrying structural bond of the composite ends to the steel shell, the composite is co-cured on the steel shell as illustrated in FIGS. 7 and 8. By alternating the stiffeners and plate connection, impedance matched joints are achieved. For that purpose, stainless steel stiffeners extend into the composite section. Scarf or stepped lap joints are used to join stiffeners or plates of both materials. In the stepped lap joint, the steel is provided with holes 27 for through-the-thickness stitching that provides strong out-of-plane bonding between steel and composite. The steel ends are then welded to the mid-section hull. To increase the structural integrity of the joint at the end-bulkheads, pre-stressing cables are used according to the present invention which are embedded in the composites along the longitudinal stiffness and are anchored to the steel frame in the embodiment of FIG. A or in the mid-section in the embodiment of FIG. 1B. While FIGS. 4, 5 and 6 illustrate this novel concept of pre-stressing cables with only a few cables, these pre-stressing cables should be distributed along the entire parameter of the hull in order to give a uniform distribution of stresses and reduce the extreme tensile stresses at the joints. The pre-stressing cables should thereby have a moment-carrying capability equal to that of the ultimate moment-carrying capacity of the composite hull section both in the vertical and lateral directions. A smooth transmission of extreme dynamic loads between the mid-section and the end sections is assured by the elastomeric material between the end bulkheads which additionally enhances water-tightness and shock absorption.

In the hull construction according to FIG. 1A, the mid-section made of steel framing carries together with the deck and the hull bottom only the bending loads as axial loads in the top and bottom frame members while the composite outer skin carries the in-plane shear and water pressure loads. In the alternative of a double-hull hybrid construction, the inner shell will carry the shear loads symmetrically with the outer skin.

In the stainless steel box frame construction of the embodiment of FIG. 1A, in addition to providing a strong foundation for machinery, the connection thereof between the outer composite shell and the box frame construction of the hull section allows for multi-paths of machinery sound and vibration and thus provides an excellent means for engineering absorption mechanisms. The steel box sections additionally provide an excellent means to absorb noise and vibration damping by filling them with polystyrene beads or foam or analogous material. The present invention will therefore lead to a dramatic reduction of machinery noise and vibrations from the hull.

Additionally, the novel concept of using pre-stressing cables to connect the bow and stern sections to the mid-section in the hull of this invention provides continuous compressive stresses along the entire connection under all design loads. Furthermore, under short duration extreme loads, beyond design loads, the present invention allows for mitigation of extreme peak underwater explosion loads by providing large deformation energy absorption and snap-back for closing the joints.

From a ship safety point of view, the strength and stiffness of the hybrid construction of FIGS. 1A and lB is not affected adversely by fire and high temperature as might be the case of a 100% composite construction because the mid-section steel framing or steel hull has a higher resistance to fire and high temperatures. Additionally, the composite decks and bulkheads provide natural insulation between compartments.

As the end sections in the embodiments of FIGS. 1A and 1B are of a length of the order of about 50 feet, they can be made in one piece using conventional composite manufacturing processes such as disclosed in U.S. Pat. No. 5,958,325, and in particularly using vacuum-assisted resin transfer molded processes.

While I have shown and described several embodiments in accordance with the present invention, it is understood that the same is not limited thereto but is susceptible of numerous changes and modifications as known to those skilled in the art. The advantages described above with the constructions according to this invention are not limited to Naval ships but are also useful for light-weight, corrosion-resistant and low maintenance commercial ships because the bow and stern geometry possible with this invention provides excellent seakeeping, increased energy, high fuel efficiency and speed. For example, when the construction of the embodiment of FIG. 1A is used in commercial ships or boat applications, the stainless steel framing can be replaced with conventional ship hull carbon steel (A36, HSLA-80 or other appropriate construction steel) or with aluminum for light-weight sea craft. Additionally, H-beams and/or I-beams may replace the built-up box sections to reduce cost. As commercial applications do not require consideration of underwater explosions, the shear connectors and elastomeric material used in the present invention may be omitted, and the composite outer skin in the embodiment of FIG. 1A can then be directly bolted to the steel framing or aluminum framing using conventional bolting. Bulkheads are then preferably embedded in the composite materials and thus completely sealed from sea water. In the embodiment of FIG. 1B, conventional or double-hull construction could be used for the mid-section using conventional ship hull carbon steel when the invention is used in commercial ships or boat applications.

Thus, the present invention is not limited to the details shown and described herein but is susceptible of numerous changes and modifications as known to those skilled in the art, and I therefore do not wish to be limited to the details shown and described herein but intend to cover all such changes and modifications as are encompassed by the scope of the appended claims.

What is claimed is:

1. A marine vessel, comprising a bow section, a mid-section and a stern section in which the bow and stern sections are of different hull construction from that of the mid-section and in which the skin of the hulls of the bow and stem sections are made substantially entirely of composite material while the hull of the mid-section includes one of a steel frame means with composite skin and of steel double hull construction.

2. A marine vessel according to claim 1, wherein the mid-section includes a hybrid stainless steel frame means with a composite outer skin.

3. A marine vessel according to claim 1, wherein the mid-section is made of steel double-hull construction.

4. A marine vessel according to claim 1, wherein the shape and length of the composite bow and stem sections is determined by the geometry complexity and minimization of bending stresses from sea loads.

5. A marine vessel according to claim 1, wherein at least one of bow and stern section are of complex curvatures for unique hydrodynamic advantage, sea keeping, maneuvering, fuel efficiency and speed.

6. A marine vessel according to claim 1, wherein said mid-section includes substantially longitudinally extending beams joined by substantially vertically and horizontally extending beams.

7. A marine vessel according to claim 1, wherein said mid-section includes two truss-like structures on the port and starboard sides which are connected to top and bottom beams to form a box-like structure providing lateral and torsional stiffness while resisting beam and oblique sea loads.

8. A marine vessel according to claim 6, wherein said beams are box-type beams.

9. A marine vessel according to claim 1, wherein said composites are made of glass reinforced plastic material.

10. A marine vessel according to claim 1, wherein said mid-section is of double-hull hybrid construction with an outer glass-reinforced plastic skin and an inner shell including the steel frame means.

11. A marine vessel according to claim 1, further comprising top and intermediate decks at least in the mid-section, and wherein at least one of top and intermediate decks are made of sandwich-type glass-reinforced plastic material.

12. A marine vessel according to claim 2, further comprising shear connector means for connecting the outer skin to the steel frame means.

13. A marine vessel according to claim 12, further comprising longitudinal beams in said mid-section, wherein said shear connector means are provided substantially along the entire length of said longitudinal beams and also along vertical and horizontal member of said steel frame means.

14. A marine vessel according to claim 12, wherein said shear connector means include two substantially concentric cylinders to transmit axial loads.

15. A marine vessel according to claim 14, wherein the outer cylinder has slots and the inner cylinder has keys to prevent disengagement of the cylinders under tensional loads.

16. A marine vessel according to claim 2, wherein elastomeric material is sandwiched between the composite skin and the frame means to provide dynamic load attenuation.

17. A marine vessel for commercial applications according to claim 2, wherein the composite outer skin is directly connected to the steel frame means by bolt means.

18. A marine vessel according to claim 17, wherein said bolt means include boltheads embedded in the composite and sealed from sea water.

19. A marine vessel according to claim 1, further comprising connecting means including pre-stressing cable means or connecting at least one of bow and stern sections to the mid-section.

20. A marine vessel according to claim 19, wherein said pre-stressing cable means have a moment-carrying capacity substantially equal to the total moment-carrying capacity of the respective composite bow and end section.

21. A marine vessel according to claim 1, further comprising water-tight end bulkhead means at the transition areas from end section to mid-section.

22. A marine vessel according to claim 2, further comprising additional connecting means between composite materials and steel frame means which includes stiffener means.

23. A marine vessel according to claim 22, wherein the additional connecting means includes staggering means between composite material and steel frame means.

24. A marine vessel according to claim 1, further comprising additional connecting means between at least one of said end sections and said mid-section including lap joint means provided with holes to enable stitching of plastic fibers to prevent delamination of the composite materials.

25. A marine vessel according to claim 1, wherein the overall length of the vessel is at least 300 feet.

26. a marine vessel according to claim 1, wherein the skin of the hull of the bow and stern sections are composites made of glass-reinforced plastic.

27. A marine vessel according to claim 1, wherein said composite material essentially consists of glass-reinforced plastic using E-class.

28. A marine vessel with a hybrid ship hull, comprising a bow section, a mid-section and a stern section, wherein the bow and stern sections are made of low cost, high performance composite materials while the mid-section has a construction of one of hybrid steel framing with a composite skin, of advanced double steel hull and of conventional hull.

29. A marine vessel according to claim 28, wherein said composite materials are fiber-reinforced composites.

30. A marine vessel according to claim 28, wherein the low-cost, high performance composite materials are glass-reinforced plastic materials.

31. A marine vessel according to claim 28, wherein the hybrid ship full has an overall length of at least 300 feet.

* * * * *